United States Patent [19]

Porter et al.

[11] 4,078,586

[45] Mar. 14, 1978

[54] METHOD AND APPARATUS FOR PRODUCING A SELVAGE

[75] Inventors: Allan William Henry Porter, Lustmuhle; Rudolph Zviener; Josef Krause, both of Arbon, all of Switzerland

[73] Assignee: Adolph Saurer Limited, Arbon, Switzerland

[21] Appl. No.: 717,931

[22] Filed: Aug. 26, 1976

[51] Int. Cl.[2] ..... D03D 47/48

[52] U.S. Cl. ..... 139/434; 139/450

[58] Field of Search ..... 139/188, 192, 429, 430, 139/434, 370.2

[56] References Cited

U.S. PATENT DOCUMENTS

| | | | |
|---|---|---|---|
| 3,137,321 | 6/1964 | Wasylewiez | 139/434 |
| 3,457,966 | 7/1969 | Cujai | 139/434 |
| 3,744,533 | 7/1973 | Yano et al. | 139/430 |

FOREIGN PATENT DOCUMENTS

| | | | |
|---|---|---|---|
| 677,255 | 6/1939 | Germany | 139/434 |

*Primary Examiner*—Henry S. Jaudon

*Attorney, Agent, or Firm*—Bailey, Dority & Flint

[57] ABSTRACT

A method and apparatus for producing a selvage on a fabric woven on a loom in which filling threads are drawn from a stationary supply outside the shed formed by the warp yarns. The method and apparatus includes inserting a first filling through the shed. The ends of the first filling are clamped by a first pair of clamps positioned on opposite sides of the shed which hold the filling in an extended position. The filling thread is beat-up into the fell of the fabric and simultaneously the ends thereof are displaced behind the fell of the fabric for engagement by a second pair of clamps. The filling is then severed outside of the second pair of clamps so that the second pair of clamps continues to hold the ends of the filling in an extended position behind the fell of the fabric. The shed is then changed and the above steps are repeated until a predetermined number of fillings are held by the second pair of clamps. A selvage insertion needle which has a hook on the end thereof simultaneously engages the ends of the fillings held by the second pair of clamps and inserts the ends of the fillings into the shed. The plurality of fillings are beat-up simultaneously during the beat-up operation of the next inserted filling.

4 Claims, 4 Drawing Figures

METHOD AND APPARATUS FOR PRODUCING A SELVAGE

BACKGROUND OF THE INVENTION

The invention relates to a method and apparatus producing a selvage on fabrics and more particularly to a method and apparatus for producing a selvage on fabric produced on looms which utilize bobbinless filling insertion members.

Heretofore, in forming a selvage on a fabric produced on a loom wherein a bobbinless filling inserting member such as projectiles, grippers, liquid streams or the like are utilized, the ends of the filling threads are turned one hundred and eighty degrees and reinserted in the shed subsequent to the beat-up of the next thread. These filling threads may be in the form of a single pick or loop.

The formation of a selvage on a fabric produced in the above described manner is a problem on account of it produces a greater fabric density in the region of the selvage. This is because in forming the selvage, the filling thread as well as the reinserted filling thread end are respectively bound by the warp threads. In one attempt to minimize this problem, weaving is performed with a looser weave for the edge region in which the selvage is to be formed as compared to the rest of the fabric. This requires additional mechanisms with the complication of necessary additional shafts and their drive which occasion considerable cost.

To prevent an excessive fabric density in the region of the selvage, it has already been proposed U.S. Pat. No. 3,457,966 to insert only every other filling thread into the shed and to leave the rest of the thread ends as an unbound edge fringe. This has the disadvantage in that the fringe must either be removed in an additional work step or by a special device on the loom.

SUMMARY OF THE INVENTION

The invention includes the method and apparatus for producing a selvage on fabric woven on a loom on which fillings are drawn from a stationary supply outside the shed formed by warp yarns and fed through the shed by a filling inserting member. A first pair of filling clamping means is carried on opposite sides of the shed for holding a filling thread in an extended position. A second pair of clamping means is normally carried behind the fell of the cloth out of the normal path of travel of the filling inserting member. A pair of projections is used for displacing the filling thread ends behind the fell of the fabric during beat up of the extended filling into the fell of the fabric and for transferring the ends of the filling to the second pair of clamping means. The shed is changed and the above steps are repeated so that said second pair of clamps holds the ends of a predetermined number of fillings. A selvage inserting needle which has a hook on the end thereof is used for simultaneously engaging the plurality of ends of the filling held by a second clamping means. It then inserts the ends of the fillings into the shed for being beat-up into the fabric with the next inserted filling.

Accordingly, it is an important object of the present invention to produce a selvage on a fabric manufactured on a loom equipped with a bobbin filling inserting mechanism.

Another important object of the present invention is to provide a method and apparatus for producing a selvage on a fabric which has a fabric density that is hardly perceptibly greater than the density of the rest of the woven fabric although all of the filling threads are reinserted into the shed and bound therein.

These and other objects and advantages of the invention will become apparent upon reference to the following specification, attendant claims and drawing.

DESCRIPTION OF A PREFERRED EMBODIMENT

Figure 1:
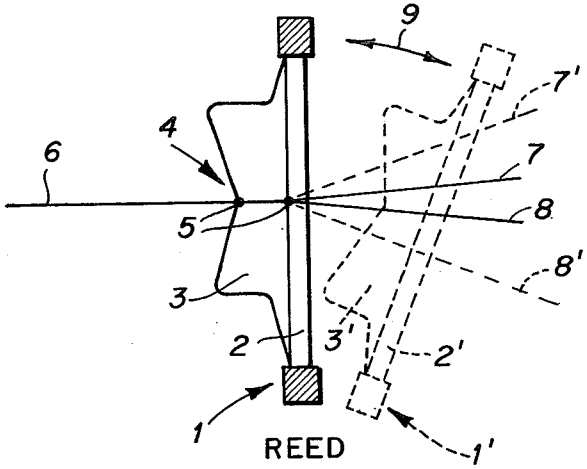
FIG. 1 illustrates a vertical section of a reed carried on a loom equipped with projections constructed in accordance with the present invention for aiding in forming a selvage on a fabric.
Figure 2:
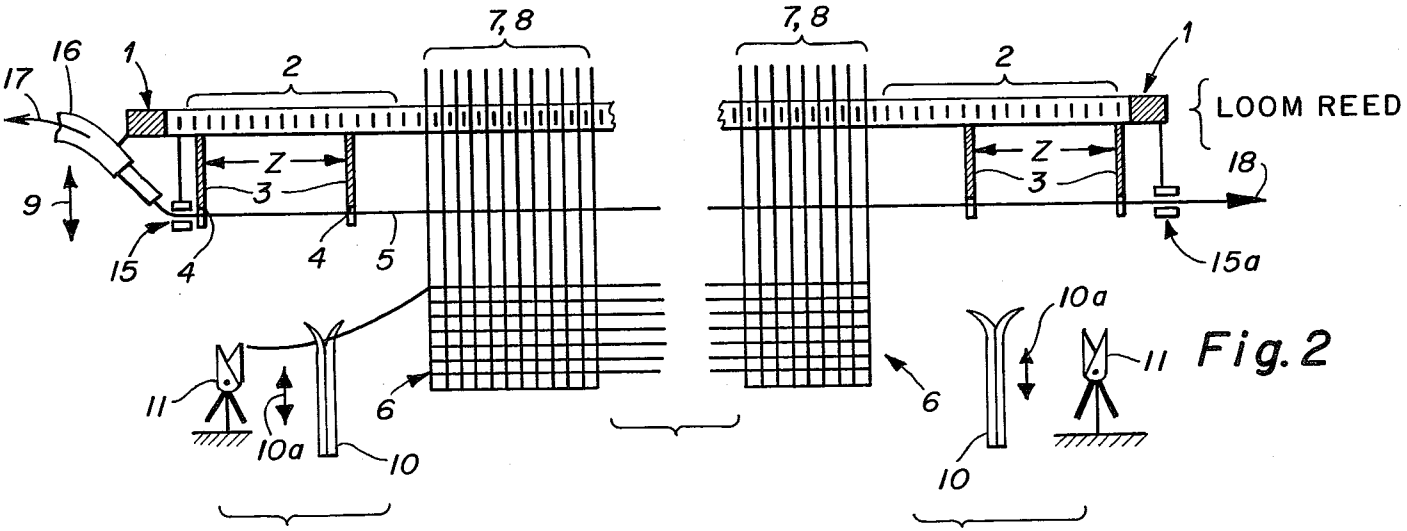
FIG. 2 illustrates a plan view of a loom equipped with apparatus constructed in accordance with the present invention illustrating the fabric and warp yarns immediately after the insertion of a filling.
Figure 3:
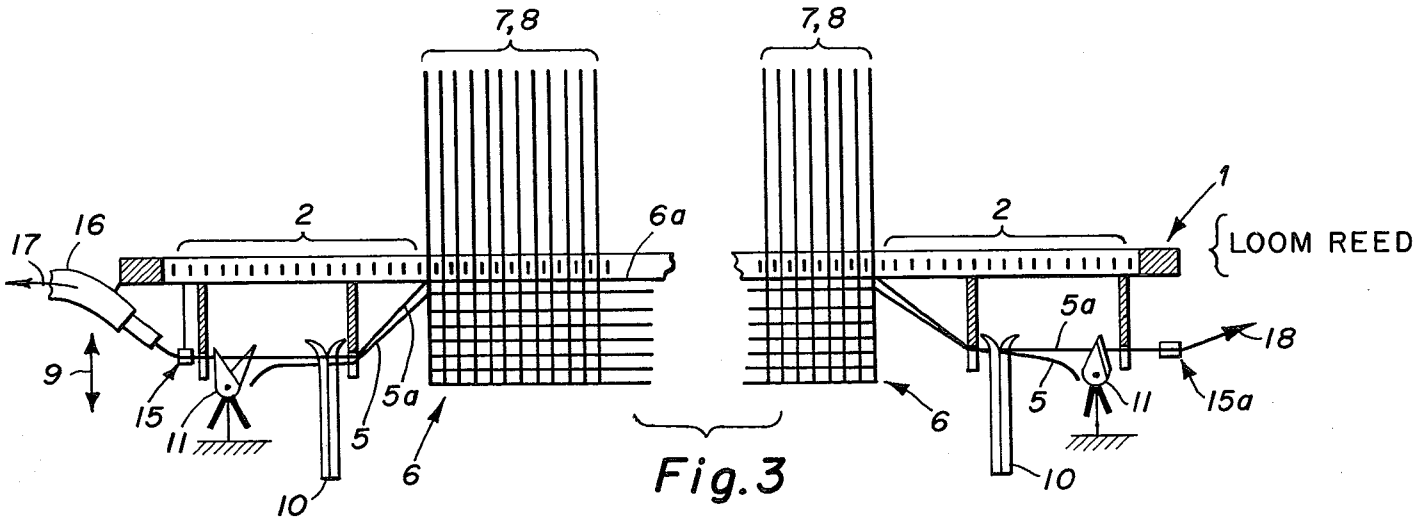
FIG. 3 is a similar plan view like that of FIG. 2 illustrating a working position immediately after beat-up of the filling.
Figure 4:
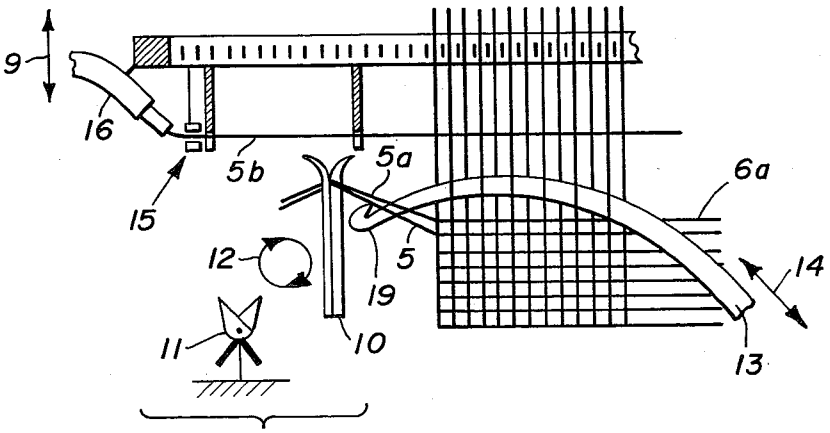
FIG. 4 is a plan view like that of FIGS. 2 and 3 illustrating a working position after a thread change in which two filling thread ends are reinserted into a shed simultaneously to form a selvage.

Referring in more detail to the drawings, a reed 1 with reed wires 2 is shown in FIG. 1 with full lines in a position in which the previously inserted filling thread 5 is beat-up into the fell 6*a* of the cloth 6 formed by yarns of the upper and lower warp yarns 7 and 8. The reed executes the back and forth motion indicated by double arrow 9 between the stop position shown in full lines (forward dead point) and the filling insertion position in FIG. 1 illustrated by dash lines. In this latter position, the reed is indicated by 1', the reed wires by 2', and the upper and lower warp by 7' and 8'. Respective pairs of projections 3 are fastened to the reed outside the weaving width and immediately close to the weaving edges with a spacing *z* between them. The projections 3 extend out beyond the reed in the beat-up direction. The projections 3 have a notch 4 which is recessed in the direction towards the reed wires and whose apex lies at the height of the fell of the cloth. A respective edge clamp 10 and a shear 11 are mounted behind the fell in the space swept by the spacing *z* as the reed 1 moves back and forth. The shears 11 remain stationary and are mounted on the frame of the loom. The edge clamps 10 are arranged on the inside and the shears 11 on the outside. The edge clamps are supported on a cross beam of the frame of the machine by means of a support for motion in the warp direction as indicated in the drawings by arrows 10*a* and 12, while the shears are stationarily supported. The direction of motion of the edge clamp is indicated by the double arrow 12 (FIG. 4) and will be explained later. It depends on the motion of the reed 1 and of the motion (indicated by the double arrow 14) of a conventional selvage inserting needle 13 which is provided with a hook 19 as indicated in FIG. 4.

Respective clamps 15 and 15*a* for the filling yarn are mounted on the sley for movement with the reed outside the region of the projections 3 with at least clamp 15 which is positioned on the side of the free filling thread end being connected to the reed 1. A suction nozzle 16, through which air is sucked in the direction of the arrow 17, is likewise fixed on the side of the free filling thread end in immediate proximity to the filling insertion line. The filling threads 5, 5*a* and 5*b* and so on are delivered from a supply, i.e. a stationary bobbin (cop) outside the shed or from a length measuring-out apparatus (not shown) toward which the arrow 18 points.

In operation, a filling thread is laid by means of a conventional filling yarn inserter (not shown) in the form of a loop into the shed formed by the threads of the upper and lower warp yarns 7 and 8. During this, the clamps 15 and 15*a* are opened. When the free filling end leaves the filling inserter, it is sucked into the suction nozzle 16 by the air flowing in the direction of the arrow 17 and is thus held extended to a certain extend. The clamp 15 is first closed, controlled by the beat-up motion of the reed following the insertion of the filling thread. At beat-up, the piece of filling thread engaged by the projections 3 is pushed behind the fell 6*a* of the fabric. The piece of the filling thread lying in the shed hence undergoes a tension, which can be adjusted within wide limits by choice of the instant time of closing of the clamp 15*a* which is on the supply side and which is likewise controlled by the motion of the reed. This tension has the result that the filling thread arrives in the notches 4 provided in the projections 3. In this way, the piece of filling lying between the projections 3 is positively fixed in its height position and pushed into the edge clamp 10 standing at the same height. When the reed 1 is in the beat-up position, the shears 11 cut the filling thread off.

After beat-up, the reed moves away from the fell, the clamp 15 opens again and the cut piece of filling, held in it up to then, is carried away be the suction nozzle 16 in the direction of the arrow 17. The filling thread ends that are now held solely by the edge clamps 10 remain held. In addition to the beat-up, a yarn change has taken place. The clamp 15*a* has remained closed until the filling thread inserter, which returned into the new shed from the side of the fabric remote from the filling yarn supply during the backward motion of the reed 1, has gripped the new filling thread 5*a* and formed the loop. Thereafter, the already-described process is repeated until a predetermined number of fillings are inserted between the clamps 10. When the prescribed number of filling thread ends held by the edge clamps 10 is reached, these thread ends are simultaneously inserted into the shed by the conventional insertion needle 13 which penetrates into the shed through the warp yarns and, after taking over the thread ends, comes out of the thread again. The motion of this needle is shown in FIG. 4 by the double arrow 14. These thread ends are then beaten up into the fabric together with the additional inserted filling thread 5*b*. For the transfer of the thread ends to the insertion needle, the edge clamp 10 executes a circular, elliptical or otherwise curved motion corresponding to the arrow 12 from its resting position behind the fell, out in the direction of the warp beam and back. Hence, the thread ends to be inserted are wrapped around the point of the insertion needle 13, gripped by its hook 19, and drawn into the shed. The needle 13 is patterned actuated so as to draw the yarn from between the clamps 10 after every other pick.

According to the invention, the apparatus is characterized in that the reed has two pair of projections 3, spaced apart from each other in the filling direction, and outside the weaving width. The projections are carried on the beat-up side of the reed in the region of the filling thread after such is inserted through the shed. The spacing between the projections of each pair of projections is sufficient to provide for entry of a clamp device for gripping and holding the filling thread ends.

The apparatus according to the invention has the advantage, among others, that the resting position of the clamp device 10 with the gripped filling thread ends can be displaced behind the fell 6*a* of the cloth so that the filling thread ends are directly moved from the filling path. Thus, there is no need for a mechanism with edge clamp, as in a known apparatus for the additional removal of the clamp device from the filling path.

The apparatus according to the invention can be constructed so that the projections are connected to the reed for adjustment in the filling direction. There is thus obtained the advantage that the weaving width can be chosen within wide limits without changing the reed and with constant selvage width. With the conventional apparatus provided with edge clamp, the excess thread length from the fabric up to the edge clamp has to be cut off in order to fulfill this last condition, with the result that additional filling thread is wasted.

As a result of providing a notch 4 in the projections 3 at the height of the filling line, the filling thread end is shifted into a definite position for proper transfer to the clamp device 10 which, as previously mentioned, is carried at the same height of the fell.

While a preferred embodiment of the invention has been described using specific terms, such description is for illustrative purposes only, and it is to be understood that changes and variations may be made without departing from the spirit or scope of the following claims.

What is claimed is:

1. The method of producing a selvage on a fabric woven on a loom in which filling threads are drawn from a stationary supply outside the shed formed by warp yarns, said method comprising:

(a) inserting a first filling through said shed, (b) clamping the ends of said first filling with a first pair of clamps on opposite sides of said shed holding said filling in an extended position, (c) beating up of said filling into the fell of said fabric and simultaneously displacing the filling ends behind the fell of said fabric for engagement by a second pair of clamps, (d) severing said filling outside of said second pair of clamps so that said second pair of clamps continues to hold the ends of said filling in an extended position behind the fell of said fabric, (e) changing the shed and repeating the steps set forth above so that said second pair of clamps holds the ends of a predetermined number of fillings, and (f) using a selvage insertion needle for simultaneously engaging said ends of said fillings held by one of said clamps of said second pair of clamps and inserting said ends of said fillings into said shed, and (g) beating up said inserted ends into the fell of said fabric simultaneously with the beating up of the next inserted filling.

2. An apparatus for producing a selvage on a fabric woven on a loom on which filling threads are drawn from a stationary supply outside the shed formed by warp yarns and fed through the shed by a filling inserting member, said loom having movable reed provided thereon, said apparatus comprising:

(a) a first pair of filling clamping means carried for movement with said reed on opposite sides of said shed in the path normally traveled by said filling inserting member for holding a filling thread in an extended position, (b) a second pair of clamping means normally carried behind the fell of said fabric out of the normal path of travel of said filling inserting member, (c) means carried with said reed for engaging said extended filling between said warp yarns and said first pair of clamping means and displacing said engaged portions behind the fell of said fabric and transferring the ends of said filling to said second pair of clamping means, and (d) means for simultaneously engaging a plurality of ends of filling threads held by each of said second pair of clamping means and inserting said ends into said shed for producing a selvage.

3. An apparatus as set forth in claim 2 for producing a selvage on a fabric woven on a loom wherein said means for displacing said engaged portions of said filling thread ends includes:

(a) a pair of projections carried on each end of the reed outside of said shed, (b) said projections of each pair of projections being spaced apart sufficiently for the entry of one of said second pair of clamping means for enabling an end of said filling to be transferred to said one of said second clamping means.

4. The apparatus as set forth in claim 3 wherein said projections extend from adjacent the top of the reed to adjacent the bottom of the reed with a central portion converging inwardly towards the reed terminating in an apex carried at approximately the same height as the fell of the cloth, so that as the reed is moved forward during the beat-up motion, the ends of the filling are engaged by the apex of said projections to be transferred to said second clamping means.

* * * * *